US007497489B2

(12) United States Patent
Baughman et al.

(10) Patent No.: US 7,497,489 B2
(45) Date of Patent: Mar. 3, 2009

(54) CONTAINER AND LID COMBINATION WITH CLOSING RING ASSEMBLY

(75) Inventors: Gary M. Baughman, Fremont, IN (US); Mark E. Scheibelhut, Auburn, IN (US)

(73) Assignee: Rieke Corporation, Auburn, IN (US)

( * ) Notice: Subject to any disclaimer, the term of this patent is extended or adjusted under 35 U.S.C. 154(b) by 197 days.

(21) Appl. No.: 11/542,529

(22) Filed: Oct. 3, 2006

(65) Prior Publication Data

US 2008/0079265 A1 Apr. 3, 2008

(51) Int. Cl.
*B65D 45/32* (2006.01)
*B65D 45/34* (2006.01)

(52) U.S. Cl. ..... 292/256.65; 292/256.69; 292/DIG. 11; 292/DIG. 49

(58) Field of Classification Search ..... 292/256.65, 292/256.69, 256.6, 256, 256.61, DIG. 49, 292/257, 258, DIG. 38, DIG. 11; 220/321, 220/315

See application file for complete search history.

(56) References Cited

U.S. PATENT DOCUMENTS

| | | | | | |
|---|---|---|---|---|---|
| 1,482,049 | A | | 1/1924 | Swanson | 220/321 |
| 2,087,732 | A | * | 7/1937 | Lockhart | 292/256.69 |
| 2,108,407 | A | * | 2/1938 | Lockhart | 292/256.69 |
| 2,236,439 | A | * | 3/1941 | Mckenna | 269/229 |
| 2,237,479 | A | * | 4/1941 | Dale | 292/256.69 |
| 2,703,431 | A | * | 3/1955 | Tatom | 16/258 |
| 3,246,793 | A | | 4/1966 | Wade | 220/321 |
| 3,889,852 | A | | 6/1975 | Strefford | 222/153 |
| 3,897,884 | A | | 8/1975 | Lankenau | 220/320 |
| 3,997,072 | A | | 12/1976 | Guth | 220/1 T |
| 4,033,454 | A | | 7/1977 | Santoni | 206/386 |
| 4,035,008 | A | * | 7/1977 | Hardt | 292/227 |
| 4,101,156 | A | | 7/1978 | Santoni | 292/256.69 |
| 4,205,761 | A | | 6/1980 | Gerster | 220/321 |
| 4,294,377 | A | | 10/1981 | Chen | 220/321 |

(Continued)

FOREIGN PATENT DOCUMENTS

DE 1 181 623 11/1964

(Continued)

OTHER PUBLICATIONS

European Search Report dated Jan. 22, 2008, issued in Application No. EP 07253425.8.

(Continued)

*Primary Examiner*—Patricia L Engle
*Assistant Examiner*—Alyson M Merlino
(74) *Attorney, Agent, or Firm*—Woodard, Emhardt, Moriarty, McNett & Henry LLP

(57) ABSTRACT

A closing ring for a container and lid combination for securing the lid to the container includes a ring body having first and second free ends to be drawn together in order to secure the lid to the container. A link clevis and a lever clevis are welded to the free ends. A link is pivotally connected to the link clevis. A lever is pivotally connected to the lever clevis. The link is connected to the lever at a third pivot connection that travels in a lever slot. The linkage arrangement is completed by the addition of a pair of closing links that are pivotally connected together and connected to the lever at the lever clevis location and to the lever at the third pivot connection.

27 Claims, 6 Drawing Sheets

U.S. PATENT DOCUMENTS

| | | | | | |
|---|---|---|---|---|---|
| 4,318,557 | A | * | 3/1982 | Bourne et al. | 292/113 |
| 4,828,299 | A | * | 5/1989 | Poe | 292/139 |
| 4,955,504 | A | | 9/1990 | Lesscher | 220/352 |
| 5,020,839 | A | | 6/1991 | Kalb | 292/256.69 |
| 5,129,537 | A | | 7/1992 | Bordner et al. | 220/321 |
| 5,219,088 | A | | 6/1993 | Reina | 220/321 |
| 5,284,270 | A | | 2/1994 | Kusta | 220/321 |
| 5,295,604 | A | | 3/1994 | Van Ryswyk | 220/321 |
| 5,299,707 | A | | 4/1994 | Stolzman | 220/321 |
| 5,411,162 | A | | 5/1995 | Koziczkowski et al. | 220/320 |
| 5,713,482 | A | | 2/1998 | Bordner et al. | 220/321 |
| 5,947,320 | A | | 9/1999 | Bordner et al. | 220/321 |
| 6,007,120 | A | | 12/1999 | Vogt et al. | 292/256.69 |
| 6,435,576 | B1 | | 8/2002 | Kusta | 292/256.67 |
| 6,540,097 | B1 | | 4/2003 | Beck et al. | 220/321 |

FOREIGN PATENT DOCUMENTS

| | | | |
|---|---|---|---|
| DE | 2 039 548 | | 2/1972 |
| DE | 75 12 896 | | 2/1977 |
| DE | 88 06 922 | | 11/1989 |
| DE | 39 24 594 | A1 | 2/1991 |
| DE | 3933995 | A1 | 4/1991 |
| EP | 0 499 191 | | 8/1992 |
| EP | 0 499 191 | A | 8/1992 |
| EP | 563567 | A1 | 10/1993 |
| EP | 1 325 873 | | 7/2003 |
| EP | 1 325 873 | A | 7/2003 |
| EP | 1783062 | A2 | 5/2007 |
| WO | WO 02/20365 | A1 | 3/2002 |

OTHER PUBLICATIONS

Rieke Packaging Systems, Drum Catalog, pre-Jan. 1, 2005, 7 pgs.
Rieke Packaging Systems Brochure, pre-Jan. 1, 2004, 3 pgs.
Rieke Packaging.com, Rieke Packaging Systems, TOV Rings, 2 pgs.
European Search Reported dated Feb. 6, 2007 issued in Appln. No. EP 06250170.5.

* cited by examiner

CONTAINER AND LID COMBINATION WITH CLOSING RING ASSEMBLY

BACKGROUND OF THE INVENTION

The present invention relates in general to a container and lid combination that uses a closing ring assembly. The closing ring is of the open-hoop style that can be used for open head drum-styled containers. Containers of the type disclosed herein may range from the smaller pail sizes of approximately 1 gallon up to much larger industrial drum sizes. The closing ring is used to securely attach a matching closing lid to the open end of the container. Containers of the type disclosed herein, formed as generally cylindrical structures with an upper, generally circular open end, are closed by tightly securing a matching lid over the open end of the container. The lid edge and container lip edge are clamped together by the closing ring. It is important to tightly connect the lid to the container in order to close and seal in the container contents and prevent any loss or leakage of those contents. The closing ring is used in cooperation with the lid and container structures for this purpose.

Since the entire contents of the container may not always be dispensed when the drum (container) is first opened after initial filling, it is important to be able to re-close the container with the matching lid with substantially the same degree of security and tightness that was achieved at the time of initial filling and closing. Presently, the two most commonly-used closing ring structures employ either a tightening bolt arrangement or an over-center lever and linkage arrangement. The bolt arrangement requires manual tightening and untightening of the bolt into or out of a nut or at least an internally-threaded block. The torque applied to the bolt and the relative sizing of the ring body relative to the diameter of the lid dictate the degree of tightness and thus the security of the lid-to-container connection. Once the lid is securely tightened onto the container by this bolt arrangement, it remains in position and is generally not at risk of loosening or coming apart. Perhaps the only risk in terms of loosening is due to vibration during shipment. The benefit of normally remaining tightly secured is offset by the time required to open and close the ring and thereby be able to remove or reapply the lid.

The over-center lever and linkage arrangement uses a linkage with multiple pivots and a lever handle that is folded to close the container and unfolded or pivoted outwardly to be able to open the container by removing the lid. The lever handle in cooperation with the pivot points and linkage members makes use of the mechanical advantage and leverage of the structure to enable a tight closing operation, while still being performed manually. By enabling the manual folding of the lever handle to apply a sufficient clamping force by means of the closing ring to properly secure the lid to the container, the time required to unthread or thread the clamping bolt of the other (first referenced) configuration is eliminated. The tighter the clamping force applied by the closing ring, the greater the level of manual force that must be applied to the lever handle. However, the relative force levels depend on the configuration of the linkage and it would be an improvement to what presently exists to be able to achieve the same ring clamping (closing) force with less lever force.

In certain prior art structures, in order to actually secure the lever and linkage combination of the closing ring in its closed condition, some external accessory such as a locking pin or tie is used. This type of accessory needs to be manually applied when the container is filled and closed and then removed at the time of initial dispensing. If the contents are not dispensed completely from the container after initial opening, and if there is some risk that the closing ring would be inadvertently opened, then the selected locking pin or tie would need to be reassembled, perhaps using a new one, and the process would then repeat itself whenever the container was opened on subsequent occasions. Whether done once or multiple times, this particular approach represents a time investment that would offset some of the benefits derived from the simplicity of the fold-to-close (over-center) lever and linkage arrangement. The concern is that without some type of accessory feature, the traditional lever handle styles of the prior art can be inadvertently flipped up and/or over to an open condition. This could occur unintentionally and inadvertently if the lever handle is caught or hooked on some other structure. This is possible during handling, loading, shipping, storage, etc. In a recent patent application filing, it is discussed that it would be an improvement to the current state of the art in container closing rings to be able to retain the reliability and simplicity of the fold-to-close linkage but add a simple and effective securing or locking feature to prevent unintentional and inadvertent opening of the closing ring. This recent application is U.S. Ser. No. 11/268,379, filed Nov. 7, 2005. An objective of this recent application is to preclude the need for any hand tool or other implement and to eliminate the use of any add-on or extra component part. The securing accessory is integrated into the closing ring assembly. It is important that while the perceived benefits are being achieved, the simplicity, strength, and reliability of the lever and linkage arrangement are not compromised. As disclosed in this recent application, a securing or locking feature is integrated into a simple, strong, and reliable closing ring construction.

While this recent application discloses one style of improvement by the addition of a push button release structure, the present disclosure provides another style of improvement for a closing ring assembly for a container and lid combination. This style of improvement is directed to a linkage design that helps to secure the ring in a closed condition. The improved linkage design that is disclosed enables the lever to be closed with less force, the clamping of the ring with greater closing force and more force required to raise the lever in order to open the closing ring, all as compared to the prior art linkages.

BRIEF SUMMARY

A closing ring for a container and lid combination for securing the lid to an open end of the container according to one embodiment of the present invention comprises a ring body having a first free end and a second free end, wherein the first and second free ends are drawn toward each other as part of manipulating the closing ring to secure the lid to the container, a lever pivotally connected at a first end to the first end of the ring body at a first pivot axis, the lever being constructed and arranged for opening and closing the ring body by pivoting about the first pivot axis, a link pivotally connected at a first end to the second end of the ring body and pivotally connected at a second end to the lever, and a closing structure pivotally connected at a first end to the lever at the second pivot axis and at a second end to the lever at the first pivot axis.

One object of the present disclosure is to describe an improved container and lid combination using an improved closing ring for securing the lid to the container.

DETAILED DESCRIPTION OF THE INVENTION

Figure 1:
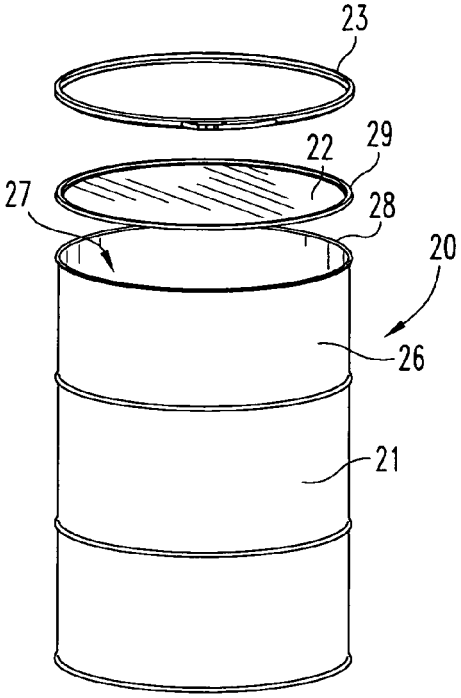
FIG. 1 is an exploded, perspective view of a closing ring, container, and lid according to a typical embodiment of the present invention.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Figure 2A:
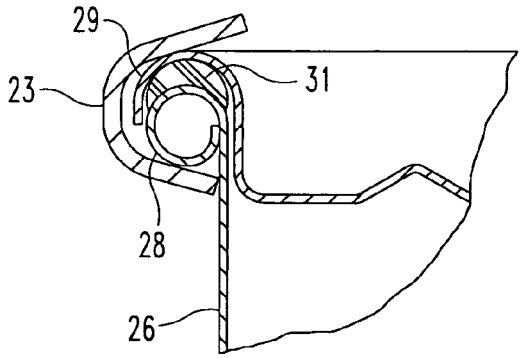
FIG. 2A is an enlarged, partial detail of the FIG. 1 closing ring, in full section, as assembled to the FIG. 1 container and lid.
Figure 2B:
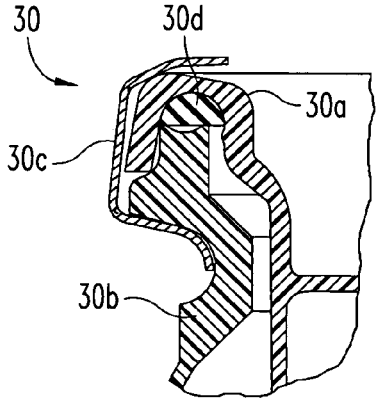
FIG. 2B is an enlarged, partial side elevational view, in full section, of the FIG. 1 closing ring as applied to a plastic container and lid combination.

Referring to FIGS. 1, 2A and 2B, there is illustrated a container assembly 20 that includes an open-end, drum-styled container 21, closed by a generally-circular matching lid 22 in cooperation with a closing ring 23. The closing ring 23 is a subassembly of multiple component parts that are in part welded together and in part pivotally connected or pinned, preferably by rivets, so as to pivot about the longitudinal axis of those rivets, as described herein. The sidewall 26 of container 21 includes a generally cylindrical, upper opening 27 surrounded by lip edge 28. Opening 27 provides access to the contents that are placed (filled) into container 21. The matching lid 22 is generally circular and includes a peripheral lip edge 29 that is constructed and arranged to interfit or otherwise cooperate with lip edge 28 as illustrated in FIG. 2A. After the lid 22 and container 21 are assembled together, the closing ring 23 is applied and positioned so as to fit on, over, and around the abutting edges 28 and 29. An annular sealing gasket 31 may be used and, if used, is positioned as illustrated in FIG. 2A. The edge-to-edge abutment, interfit, or cooperation of edges 28 and 29 for the metal construction is diagrammatically illustrated in FIG. 2A. The edge-to-edge abutment, interfit, or cooperation for a plastic pail is diagrammatically illustrated in FIG. 2B. Pail 30 includes lid 30*a*, pail body 30*b*, closing ring 30*c*, and annular sealing gasket 30*d*. For the description of the preferred embodiment and any alternate embodiments, the FIG. 2A metal construction has been selected. This metal construction corresponds to what is illustrated in FIG. 1.

Figure 3:
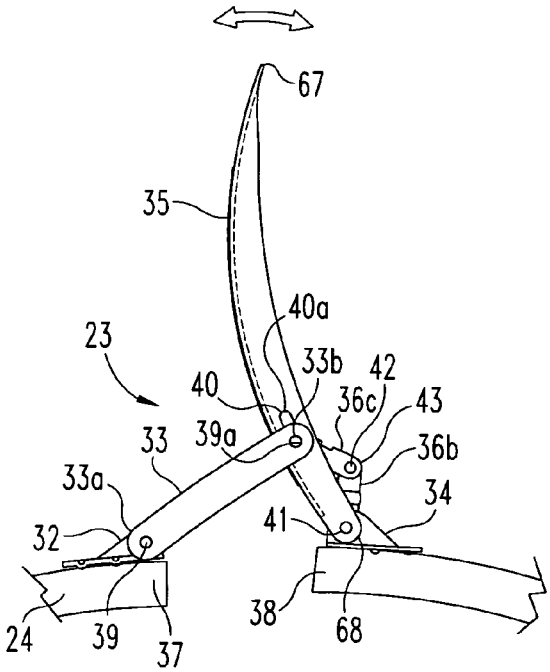
FIG. 3 is a partial, top plan view of the FIG. 1 closing ring in an open condition, as it is applied to a container and lid.
Figure 4:
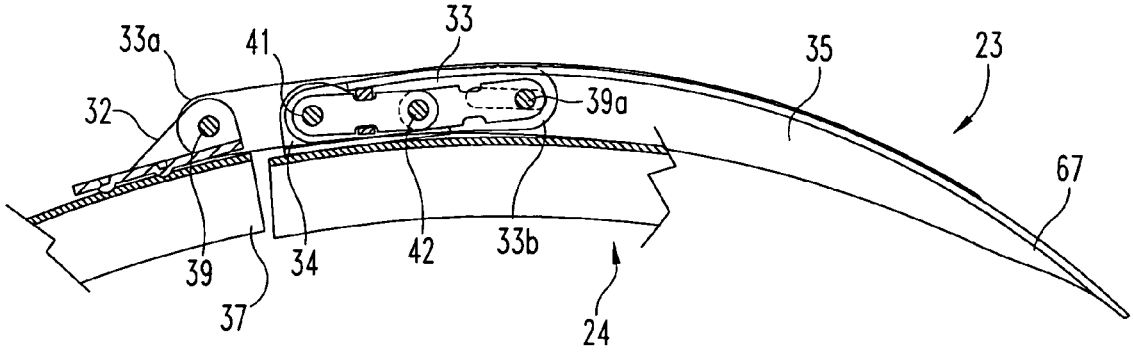
FIG. 4 is a partial, top plan view, in partial section, of the FIG. 1 closing ring in a closed condition.

Referring to FIGS. 3 and 4, the structural details of closing ring 23 are illustrated. Closing ring 23, which as described herein is an assembly of various component parts and a subassembly of container assembly 20, includes the ring body 24, link clevis 32, two shorter links 33, lever clevis 34, lever 35, and three groupings 36*b* and 36*c* of closing links 36 (see FIG. 16). One option for shorter links 33 is to manufacture these from a unitary piece with spaced sides and a connecting portion. This alternate construction could facilitate assembly if the handling of two separate pieces is awkward. One of the three groupings of closing links 36 includes three links 36 that are in stacked alignment and banded together by rubber retainer 44 which is fitted around the notches 36*a* of the group of links 36, see FIGS. 19 and 20. The other two of the three groupings of closing links 36 each include two links 36 that are in stacked alignment. The stack up of links 36, clevis 34, lever 35, and links 33 is illustrated in the front elevational view of FIG. 21. A total of seven (7) links 36 are used. However, one option contemplated is the casting or forging of a single link for grouping 36*b* and single links for each of the two groupings 36*c*. If a single link is used for grouping 36*b*, then that link will have a thickness corresponding to the stack of three individual links 36. This single link would still require the notches 36*a* for purposes of receiving rubber retainer 44. As far as the other two groupings of links 36, if those are changed to a double thickness link, that double thickness link would not require the notches. Considering this design option, the two groupings 36*b* and 36*c* can be thought of as being first and second closing links. The pivotally connected combination of these two closing links or groupings constitutes a closing structure due to its use in closing the ring body.

Figure 21:
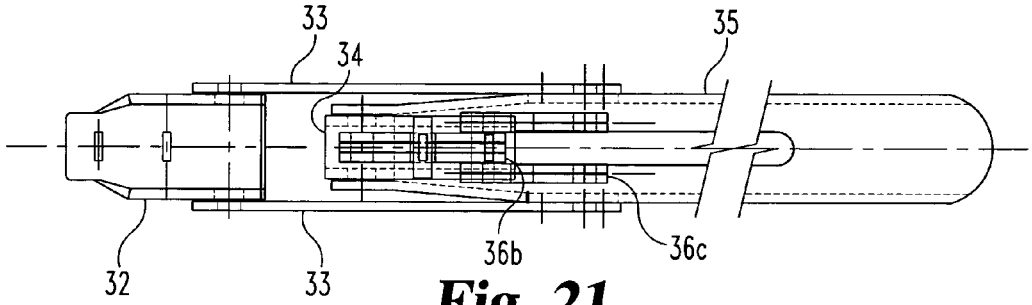
FIG. 21 is a front elevational view of the FIG. 1 closing ring.

More specifically in terms of the assembly that is illustrated in FIG. 21, the one grouping 36*b* is positioned on the interior of clevis 34 between the two clevis side panels. The side panels of lever 35 fit on the outside of the clevis 34. The two groupings 36*c* fit on the interior of lever 35 and are located (one each) on opposite sides of the single grouping

36*b* of three links 36. Links 33 are positioned on the outside of clevis 32 and on the outside of lever 35.

An alternative closing structure as a replacement for the two groupings 36*b* and 36*c* has been conceived of for use with lever 35 and the cooperating component parts of closing ring 23. This alternative closing structure includes a spring member that is shaped to fit in lever 35 at the same general location of the two groupings 36*b* and 36*c*. One end of the spring member cooperates with rivet 39*a* for enabling the added movement in slot 40 for increased ring closing force. The other end of the spring member is pivotally connected to lever 35. A bent wire form can be used for this alternative closing structure.

Clevis 32 is welded to one free end 37 of ring body 24 and clevis 34 is welded to the opposite free end 38 of ring body 24. Each link 33 is pivotally connected (pinned) at end 33*a* to clevis 32 by means of rivet 39. As would be understood, each link 33, once secured to link clevis 32 by rivet 39, is able to pivot about the longitudinal axis of rivet 39. End 33*b* of each link 33 is pivotally connected (pinned) to lever 35 by a second rivet 39*a*, as illustrated in FIG. 3. Lever 35 is slotted in a direction along its length, producing an oblong slot 40 in each side panel of lever 35 that is in alignment with and receiving rivet 39*a*. Once again, as would be understood, each link 33 is able to pivotally move relative to lever 35 and lever 35 is able to pivot relative to each of the two links 33 about the longitudinal axis of rivet 39*a*. Lever 35 is pivotally connected (pinned) at one end 68 to clevis 34 by means of a shorter rivet 41. Consistent with the foregoing description, lever 35 is able to pivot about the longitudinal axis of rivet 41. The one grouping 36*b* and each one of the two groupings 36*c* are pivotally connected (pinned or riveted) together at their adjacent ends by rivet 42. The opposite end of each grouping 36*c* is pivotally connected to link 33 and to lever 35 by rivet 39*a*. The opposite end of grouping 36*b* is pivotally connected to clevis 34 and lever 35 by rivet 41. It will be understood that the distance of separation between the pivot location defined by rivet 39*a* within the first and second slots 40 and the pivot location defined by rivet 41 is a variable, depending on the location of rivet 39*a* within slots 40. The reference to a plurality of slots 40 is based on the fact that the lever 35 has two side panels that are spaced apart from one another and there is a corresponding slot 40 in each side panel and those two slots are aligned with each other.

Figure 3A:
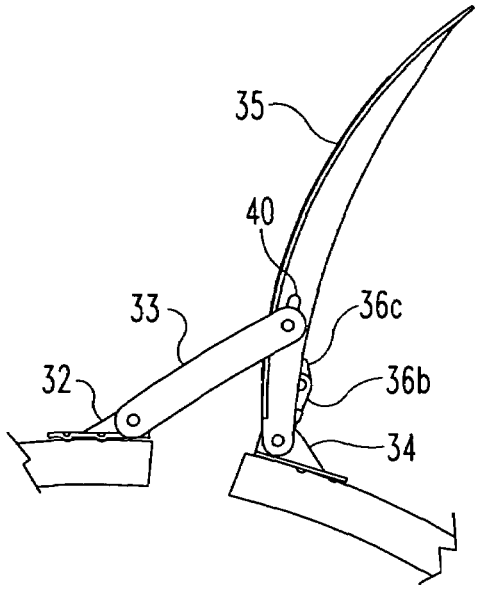
FIG. 3A is a partial, top plan view of the FIG. 1 closing ring in an intermediate position between the open condition of FIG. 3 and the closed condition of FIG. 4.
Figure 3B:
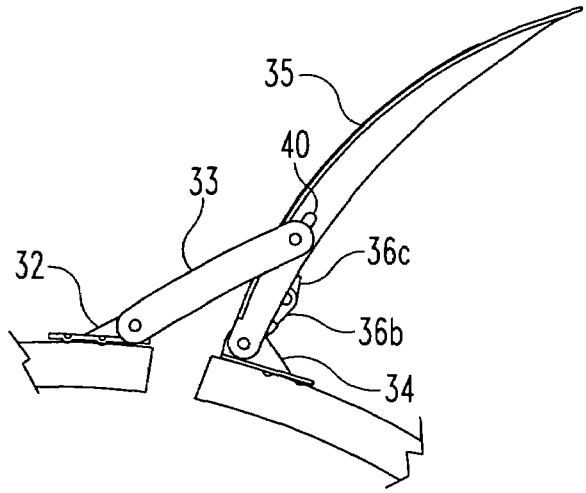
FIG. 3B is a partial, top plan view of the FIG. 1 closing ring in an intermediate position between the open condition of FIG. 3 and the closed condition of FIG. 4.

When rivet 39*a* is positioned at or near the end 40*a* of each slot 40, the length from rivet 39*a* to rivet 41 is longer than the extended (linear) combined length of the connected groupings 36*b* and 36*c* of closing links 36. This construction enables the pivotally connected groupings 36*b* and 36*c* to push the rivet 39*a* toward the far end of slots 40. Rivet 39*a* does not abut against the end 40*a* of slot 40. Some clearance remains when the two groupings 36*b* and 36*c* are fully extended to their maximum (connected) length. This linkage arrangement results in additional movement of the free ends of the ring body toward each other and thereby results in additional clamping or closing force of the ring around the lid and container subassembly. The closed configuration of ring 23 is illustrated in FIG. 4. FIGS. 3A and 3B illustrate intermediate states of ring 23 between the fully open form of FIG. 3 and the fully closed condition of FIG. 4. The various component parts that have been illustrated for the closing ring 23 assembly are illustrated in FIGS. 5-18.

Referring now to FIG. 3, the "open" condition of the closing ring 23 is illustrated. The positioning and connections of the individual components have been explained. The arrangement of linkages, their lengths, angles, and the various force vectors that are involved cause rivet 39*a* to position itself within oblong slots 40 in close proximity to each slot end 40*a*. This configuration contributes to the type of "folded" form of closing link groupings 36*b* (one) and 36*c* (two) with the rivet 41 location being moved away from the ring body 24.

Progressing through the stages from an open condition (FIG. 3) to a fully closed condition (FIG. 4), a first intermediate stage or condition is represented by FIG. 3A. In FIG. 3A, the lever 35 has moved (i.e., pivoted) farther to the ring in a clockwise direction based up on the FIG. 3A top plan view. This action pulls on the two links 33 and draws the free ends 37 and 38 of the ring body 24 closer together. FIG. 3A depicts a closing ring position just as the lever 35 begins to move through the cam cross over point represented by a line drawn from the center axis of the ring body through rivet 41. The force required to move lever 35 from the FIG. 3 position to the FIG. 3A position continues to increase.

Referring now to FIG. 3B, this drawing depicts the lever 35 and closing ring position and configuration after the lever 35 has passed through the cam cross over point. Typically, from this position to the final closed condition of FIG. 4, less force is required to complete the closing process of lever 35 as compared to the force requirement in order to go from the FIG. 3A condition to the FIG. 3B condition. This difference in forces is due to the mechanical advantages created by the linkage arrangement and the reality of how an over-center cam arrangement is designed to function.

In this described progression of movement of lever 35 from FIG. 3 to FIG. 4 by way of the intermediate conditions of FIGS. 3A and 3B, the pivotally connected three groupings 36*b* and 36*c* of closing links 36 generally maintain the folded form as well as their general positional relationship relative to lever 35. It is also important to note that when the lever reverses its orientation by flipping over or passing through the cam cross over point, the folded apex 43 (at rivet 42) between the connected groupings 36*b* and 36*c* is now pointed at the ring body 24 (see FIG. 3B), rather than being pointed away from the ring body 24 as illustrated in FIGS. 3 and 3A. As the lever 35 is moved toward the FIG. 4 configuration, the folded apex 43 begins to contact and interfere with the outer surface of the ring body 24. This interference causes the folded apex 43 to be moved in a manner that then tends to unfold or straighten out the connected groupings 36*b* and 36*c*. This manner of movement is permitted due to the presence of slots 40 and the overall length of slots 40. Importantly, the ability for groupings 36*b* and 36*c* to straighten out is dependent on the distance of slots 40 from (pivot) rivet 41. As the groupings are straightened due to interference with either the clevis 34 or the ring body 24, rivet 39*a* is pushed toward the opposite ends 40*b* of the corresponding slots 40. This enables the connected groupings of closing links 36 to hinge or flex so as to become straighter as a way to lessen or relieve the interference. As the lever 35 is closed against the ring body, the three groupings 36*b* and 36*c* straighten out and force rivet 39*a* toward the far end 40*b* of each slot 40. This movement of rivet 39*a* is away from the location of rivet 39 and this in turn requires that free ends 37 and 38 move closer together. This additional movement of approximately ⅛ inch is caused by the presence of the three groupings 36*b* and 36*c* and in turn this results in a greater closing or clamping force by the ring around the lid and container subassembly.

With regard to the use of rubber retainer 44, this component bands together three links 36 into grouping 36*b* and it also functions as a spring member. As the lever 35 moves to a fully closed condition (see FIG. 4), the three groupings 36*b* and 36*c* of links 36 straighten out to their maximum assembled (pinned) length and then fold in the opposite direction from how they are pivoted or folded in their starting orientation, such as that represented by FIG. 3. This folding in the referenced opposite direction is very minor in terms of the degree of flexing, but it does occur and presents one of the reasons for incorporating a spring member such as retainer 44. As this movement occurs, the upper portion 44*a* of retainer 44 that encircles the one grouping 36*b* of three links 36, is pushed against the inner surface 35*a* of lever 35. Upper portion 44*a* is now sandwiched between the upper notch surface of each link and the inner surface 35*a* of lever 35 and is compressed in that position. The elastomer used for retainer 44 causes this construction and its compressed state to function as a spring, tending to want to push grouping 36*b* and thereby connecting rivet 42 in a clockwise direction based on the FIG. 4 orientation.

When lever 35 is moved in a counterclockwise direction in order to release the closing ring 23 and open the container 21, it is important to ensure that the three groupings, 36*b* and 36*c*, pivot in the desired direction so as to be configured into the folded condition or orientation of FIG. 3. The use of retainer 44 and its manner of placement and positioning ensures that this will occur by actually pushing on the grouping 36*b* in a clockwise direction. The opening of lever 35 follows the reverse sequence and includes the reverse movements of what occurred when lever 35 was pivoted to the closed condition of FIG. 4.

It is understood that without the use of the pivotally connected groupings of closing links 36 and the use of slots 40 in lever 35, the maximum force exerted on the lever 35 during the ring closing operation or at least the anticipated force required for closing of a typical industrial drum is approximately 60 pounds. This is based on the selected size and style of container, lid, gasket, and closing ring as illustrated. This comparison is simply between that selected style and that same style with the closing links added and the slots introduced into lever 35. For the structure without the use of the closing links and slots, the force required to flip up lever 35 for opening is approximately 9 pounds. When the groupings 36*b* and 36*c* are added to the linkage combination, the mechanical leverage and advantages change significantly. The closing force required on the lever is assisted by the action of these closing links and by the presence of slots 40. As such, the anticipated or requisite force level for closing of lever 35 is reduced to approximately 30 pounds. The force require to flip up lever 35 for opening is increased from 9 pounds up to approximately 12 pounds. Importantly, as has been noted, in addition to these force level improvements, the free ends of the closing ring are moved closer together by approximately ⅛ of an inch. This ⅛ of an inch movement is due to the two closing links and is permitted by the ability of rivet 39*a* to move within slots 40. It has been learned that this approximate ⅛ of an inch movement creates an increased clamping (tightening) force of the closing ring around the lid and container subassembly, thereby providing a tighter and more secure closed combination. The reduction in the required closing force on the lever, the increase in the required opening force on the lever, and the tighter clamping of the ring around the lid and container subassembly are all improvements to this type of container construction. The closing force is roughly one half of what it would be without the addition of the closing links and slot and this makes the closing task easier. The opening force has been increased by approximately one third and this makes inadvertent or unintentional opening less likely. The clamping force or tightness of the closing ring around the lid and container subassembly is greater for a more secure and more reliable closure. These improvements are made possible by the addition of the connected groupings of closing links 36 and by the slotting of lever 35 and spring retainer 44.

Figure 5:
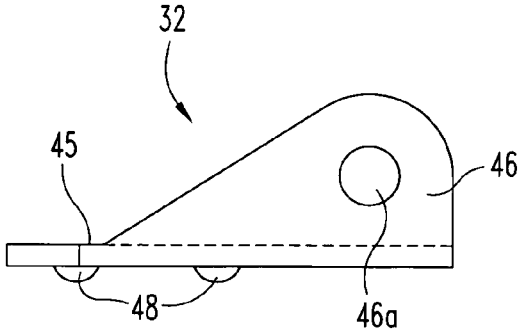
FIG. 5 is a front elevational view of a link clevis comprising one part of the FIG. 1 closing ring.
Figure 6:
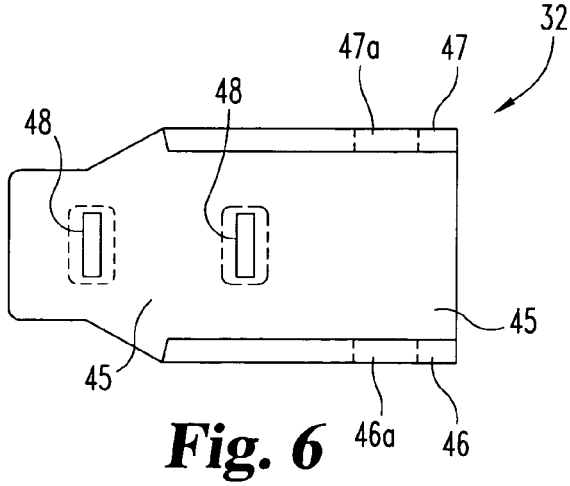
FIG. 6 is a top plan view of the FIG. 5 link clevis.
Figure 7:
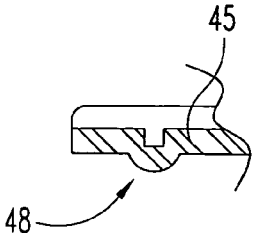
FIG. 7 is an enlarged, front elevational view, in full section, of a resistance weld projection comprising a portion of the FIG. 5 link clevis.

Referring now to FIGS. 5, 6, and 7, the details of link clevis 32 are illustrated. Link clevis 32 is a unitary, metal component that includes a base 45 and opposing and spaced-apart sides 46 and 47. A clearance hole 46*a* is defined by side 46 and an aligned clearance hole 47*a* is defined by side 47. Aligned holes 46*a* and 47*a* receive rivet 39. The base 45 is formed with a pair of resistance weld projections 48 that melt during the welding operation to aid in rigidly and securely attaching link clevis 32 to free end 37 of ring body 24. The orientation of link clevis 32, as it is welded to end 37, is illustrated in FIGS. 3 and 4. Sides 46 and 47 are set at the desired spacing or separation for the desired spacing for the two links 33. As is illustrated, one link 33 is positioned against the outer surface of side 46 and the other link, in an aligned manner, is positioned against the outer surface of side 47. In terms of a drawing convention for the component parts and the closing ring 23 assembly, the component parts are oriented as a separate, free-standing part. Therefore, FIG. 5, for example, is presented as a front elevational view. However, when this part is assembled into closing ring 23 and the ring is applied to the lid and container, this part changes to a top plan view orientation, due to how the container is oriented. The orientations of FIGS. 3 and 4 are looking down onto the top of the lid and container and the drawing descriptions are presented as top plan views.

Figure 8:
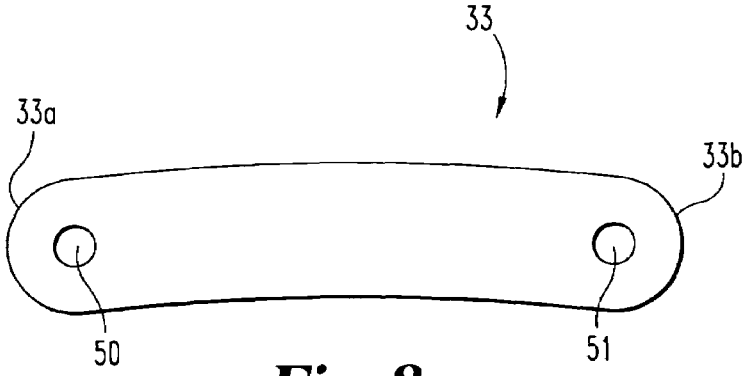
FIG. 8 is a front elevational view of a link comprising a part of the FIG. 1 closing ring.
Figure 9:
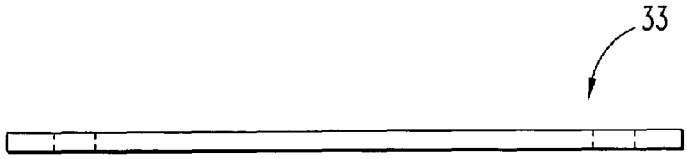
FIG. 9 is a top plan view of the FIG. 8 link.

Referring to FIGS. 8 and 9, each link 33 is a substantially flat, unitary metal plate with a slight curvature to its outer edge periphery. Its length between its two pivot points (50 and 51) is selected based upon the pivot point connection locations for the linkage and the need to be able to open the closing ring 23 a sufficient amount to apply the ring and lid to the container and to remove the lid 22 from container 21. With regard to this particular relationship, putting those pivot point locations farther apart would equate to generating more clearance. However, the length is also a factor in determining how tightly the closing ring body 23 will clamp the lid 22 to the container 21. For this particular part of the overall operation, a shorter length would equate to a tighter clamping force, but it would also equate to requiring more manual force on lever 35 in order to move it to a closed condition, as is illustrated in FIG. 4.

Each link 33 defines a first rivet hole 50 at end 33*a* and a second rivet hole 51 at end 33*b* (see FIG. 8). Rivet hole 50 on one link 33 is aligned with hole 46*a*. Rivet hole 50 on the other link 33 is aligned with hole 47*a*. Once all four holes are aligned with each other, the rivet 39 is inserted through the four holes and then headed at its straight end to complete this phase of the assembly procedure in order to create this pivot point location. The spacing created for the two links 33, by way of the spacing between sides 46 and 47 of clevis 32, corresponds to the spacing required for the two links 33 to properly span the width or spacing of the side panels 64 and 65 of lever 35.

Figure 10:
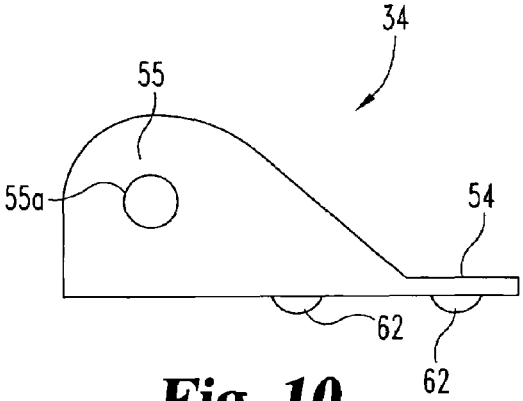
FIG. 10 is a front elevational view of a lever clevis comprising one part of the FIG. 1 closing ring.
Figure 11:
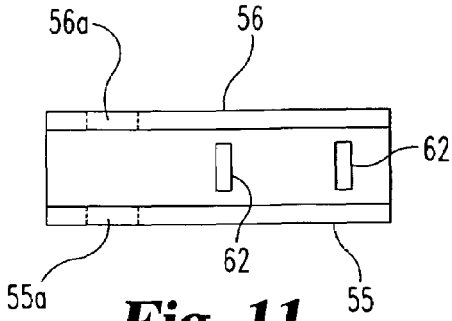
FIG. 11 is a top plan view of the FIG. 10 lever clevis.
Figure 12:
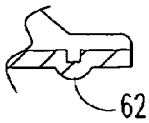
FIG. 12 is an enlarged, front elevational view of a resistance weld projection comprising a portion of the FIG. 10 lever clevis.

Referring now to FIGS. 10-12, the details of lever clevis 34 are illustrated. Clevis 34 is a unitary, metal component that includes a base 54, and opposing, spaced-apart sides 55 and 56. The base 54 is formed with a pair of resistance weld projections 62 that melt during the welding operation to aid in rigidly and securely attaching lever clevis 34 to the free end 38 of ring body 24, see FIG. 3. Sides 55 and 56 each define a corresponding clearance hole 55*a* and 56*a*, respectively. These two holes are aligned and cooperate with lever 35 to establish a pivot point connection for lever 35 by way of rivet 40, see FIG. 4.

Figure 13:
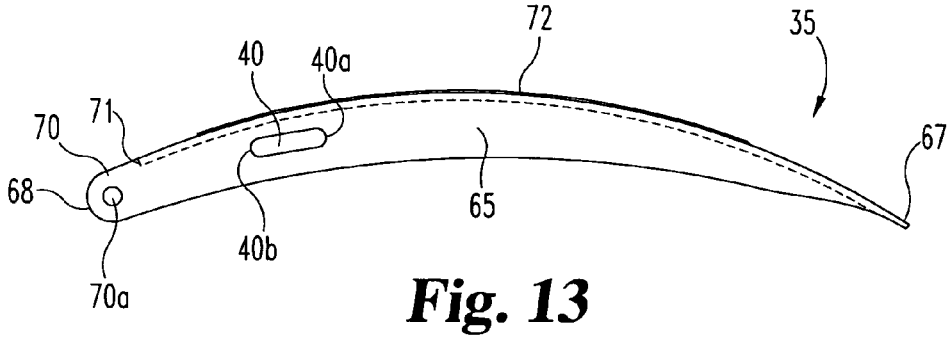
FIG. 13 is a front elevational view of a lever comprising a portion of the FIG. 1 closing ring.
Figure 14:
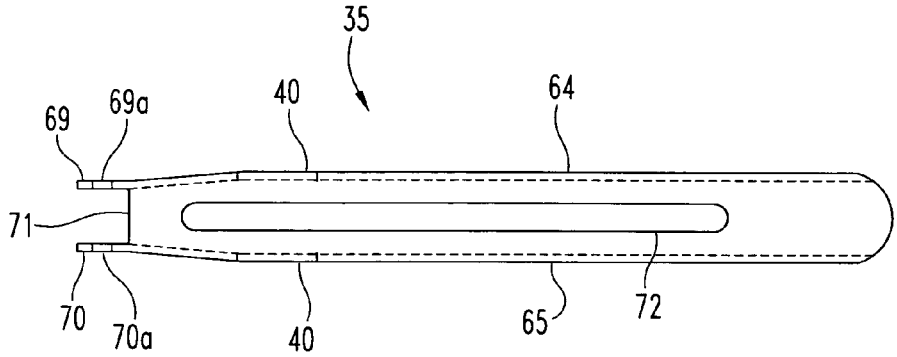
FIG. 14 is a top plan view of the FIG. 13 lever.
Figure 15:
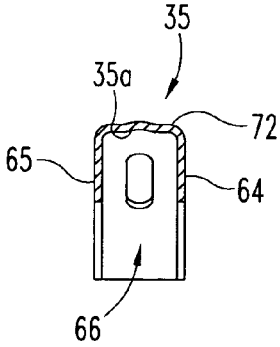
FIG. 15 is an end elevational view, in full section, of the FIG. 13 lever.

Referring now to FIGS. 13-15, the details of lever 35 are illustrated. Lever 35 is a unitary, formed metal structure that is shaped with opposing side panels 64 and 65 that define interior clearance space 66. End 67 is tapered while the opposite end 68 has a clevis configuration defined by sides 69 and 70 that extends beyond the edge 71 of outer panel 72. Sides 69 and 70 assemble over lever clevis 34 such that side 69 slides against side 56 and side 70 slides against side 55. Side 69 defines rivet hole 69*a* and aligned therewith, side 70 defines rivet hole 70*a*. When lever 35 is properly assembled onto and aligned with clevis 34, holes 55*a*, 56*a*, 69*a*, and 70*a* are all aligned in a substantially straight, axial line. These four holes receive rivet 41 and, once the rivet is inserted, its straight end is headed in order to secure this pivot point connection together, see FIGS. 3 and 4. The one grouping 36*b* of three links 36 that are banded together by retainer 44 are positioned on the inside of clevis 34 between sides 55 and 56. A first pivot hole 36*d* is defined by each link 36 and spaced therefrom is a second pivot hole 36*e* (see FIGS. 16 and 17). For grouping 36*b*, the three pivot holes 36*d* are aligned and are positioned in axial alignment with holes 55*a*, 56*a*, 69*a*, and 70*a* for receiving rivet 41.

Side panel 64 defines a first pivot slot 40 and side panel 65 defines a second pivot slot 40 that is aligned with the first pivot slot. End 33*b* of each link 33 connects to lever 35 at the location of the first and second slots 40. One link 33 is positioned against the outer surface of side panel 64 while the other link 33 is positioned against the outer surface of side panel 65. Once both holes 51 and the corresponding slots 40 are axially aligned, rivet 39*a* is inserted. The straight end of rivet 39*a* is headed in order to secure together the two links 33 and lever 35 at this pivot point connection location. Additionally, the two groupings 36*c* of two links 36 each are positioned at one end on the outside of grouping 36*b* and pivotally connected by rivet 42. The opposite end of each grouping 36*c* defines aligned pivot holes 36*e*. These four aligned pivot holes 36*e* are positioned in alignment with slots 40 and holes 51 in order to receive rivet 39*a*.

As would be understood, once rivets 39, 41, and 39*a* are each properly inserted through their corresponding set of aligned openings, a longitudinal pivot axis is created through the center of each rivet, as would be understood from the described construction and from the illustrations of FIGS. 3 and 4. The two links 33 are able to pivot about the pivot axis defined by rivet 39 relative to link clevis 32 at end 37. In a similar manner, lever 35 is able to pivot about the longitudinal axis defined by rivet 41 relative to lever clevis 34 at end 38. A further pivot point location for this linkage is at the location of rivet 39*a* that connects the two links 33 and the two groupings 36*c* with lever 35. In this instance, the links and the two groupings 36*c* are able to pivot relative to lever 35 and lever 35 is able to pivot relative to each of the two links about the longitudinal axis line defined by rivet 39*a*. The final pivot point location is defined by rivet 42 that connects the one grouping 36*b* of three links 36 with the pair of groupings 36*c* of two links 36 each.

Figure 16:
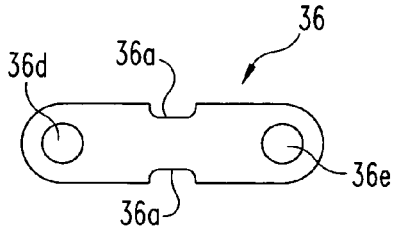
FIG. 16 is a top plan view of a closing link comprising one part of the FIG. 1 closing ring.
Figure 17:
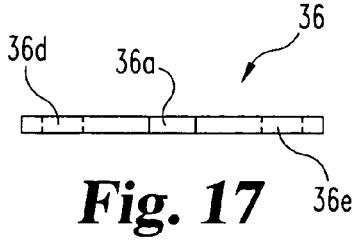
FIG. 17 is a front elevational view of the FIG. 16 link.

Referring to FIGS. 16 and 17, the details of one closing link 36 are illustrated. Closing link 36 is a substantially flat, unitary metal plate of uniform thickness and radiused ends. The main body of the closing link 36 defines a pair of spaced-apart rivet holes 36*d* and 36*e* that receive rivets, as described. A pair of oppositely disposed notches 36*a* are defined by the outer peripheral edges and centered between rivet holes 36*d* and 36*e*.

Figure 18:
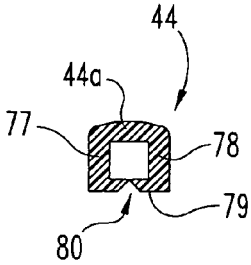
FIG. 18 is a front elevational view, in full section, of a retainer comprising one part of the FIG. 1 closing ring.
Figure 19:
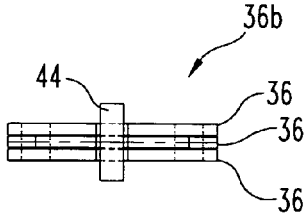
FIG. 19 is a front elevational view of a banded grouping of closing links comprising one part of the FIG. 1 closing ring.
Figure 20:
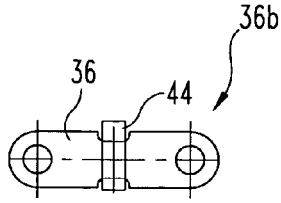
FIG. 20 is a top plan view of the FIG. 19 banded grouping.

Referring now to FIG. 18, the lateral section of retainer 44 is illustrated. This unitary, molded part has an upper portion 44*a*, sides 77 and 78, and a base 79 that is severed at notch 80. Cutting through base 79 at its midpoint allows the sides to flex outwardly so that retainer 44 can be banded around the three links 36 that comprise grouping 36*b* and fit into notches 36*a*. The banded grouping 36*b* is illustrated in FIGS. 19 and 20. As can be seen, the upper portion 44*a* is non-symmetrical relative to the lower portion provided by base 79. Retainer 44 is designed in this manner since it is the upper portion that abuts up against the inside surface of the lever 35 and it is this portion which is compressed between the lever and the upper surface of the notches 36*a*.

A side elevational view of the assembled combination of parts, without the required rivets, comprising closing ring 23 is illustrated in FIG. 21.

Figure 22:
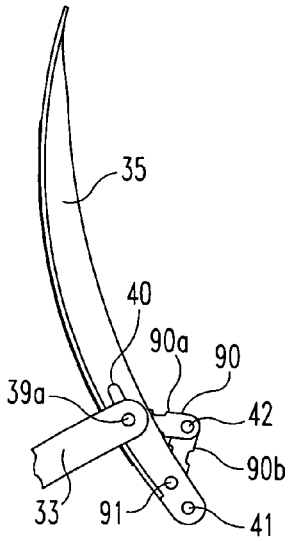
FIG. 22 is a partial, top plan view of an alternative embodiment of the present invention.

One alternate embodiment for closing ring 23 relates to the size and connection of groupings 36*b* and 36*c*. As illustrated in FIG. 22, one option is to shorten the length of each link 36 in order to create alternate link 90. The stack of three links 90 as grouping 90*a* is still pivotally connected to the stack of two links 90 as grouping 90*b* by rivet 42. The rubber retainer 44 is still used as a band positioned around grouping 90*a* by seating in the centered notches of each link 90. With a shorter connected length, a new pivot location is required. While one end of grouping 90*a* is still connected to lever 35 and link 33 by rivet 39*a*, the free end of grouping 90*b* is pivotally connected to lever 35 at the pivot location defined by rivet 91.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A closing ring for a container and lid combination for securing the lid to an open end of said container, said closing ring comprising:

a ring body having a first free end and a second free end, wherein said first and second free ends are constructed and arranged to be drawn toward each other as part of manipulating said closing ring to secure said lid to said container;

a lever pivotally connected at a first end with said first free end of said ring body at a first pivot axis, said lever being constructed and arranged for opening and closing said ring body by pivoting about said first pivot axis;

a link member pivotally connected at a first end with said second end of said ring body and pivotally connected at a second end to said lever at a second pivot axis; and a closing structure pivotally connected at a first end with said lever at said second pivot axis and at a second end with said lever at said first pivot axis.

2. The closing ring of claim 1 wherein said closing structure includes a first closing link that is pivotally connected to a second closing link.

3. The closing ring of claim 2 wherein said closing structure further including a spring-biasing structure used in combination with said first and second closing links.

4. The closing ring of claim 3 wherein said spring-biasing structure includes an elastomeric member assembled to said second closing link.

5. The closing ring of claim 4 which further includes at least one additional link used in combination with the first closing link.

6. The closing ring of claim 5 which further includes at least one additional link used in combination with the second closing link.

7. The closing ring of claim 3 wherein said lever is connected with the first end of said ring body by pivotal connection with a lever clevis member that is joined to said first end.

8. The closing ring of claim 7 wherein the connection of said lever and said lever clevis member includes a lever pivot member that is inserted through said lever clevis member and through said lever.

9. The closing ring of claim 8 wherein said link member is connected with the second end of said ring body by pivotal connection with a link clevis member that is joined to said second end.

10. The closing ring of claim 9 wherein the connection of said link member and said link clevis member includes a link pivot member that is inserted through said link clevis member and through said link member.

11. The closing ring of claim 1 wherein said lever is connected with the first end of said ring body by pivotal connection with a lever clevis member that is joined to said first end.

12. The closing ring of claim 11 wherein the connection of said lever and said lever clevis member includes a lever pivot member that is inserted through said lever clevis member and through said lever.

13. The closing ring of claim 1 wherein said link is connected with the second end of said ring body by pivotal connection with a link clevis member that is joined to said second end.

14. The closing ring of claim 13 wherein the connection of said link member and said link clevis member includes a link pivot member that is inserted through said link clevis member and through said link member.

15. A closing ring for a container and lid combination for securing the lid to an open end of said container, said closing ring comprising:

a ring body having a first free end and a second free end, wherein said first and second free ends are drawn toward each other as part of manipulating said closing ring to secure said lid to said container;

a lever pivotally connected at a first end with said first free end of said ring body at a first pivot axis, said lever being constructed and arranged for opening and closing said ring body by pivoting about said first pivot axis;

a link member pivotally connected at a first end with said second end of said ring body and pivotally connected at a second end to said lever at a second pivot axis;

a first closing link having a first end and an opposite second end;

a second closing link having a first end and an opposite second end; and wherein the first end of said second closing link is pivotally connected to the second end of said first closing link, the first end of said first closing link being pivotally connected with said lever and said link member at said second pivot axis, and the second end of said second closing link being pivotally connected with said lever at said first pivot axis.

16. The closing ring of claim 15 which further includes a spring-biasing structure used in combination with said first and second closing links.

17. The closing ring of claim 16 wherein said lever is connected with the first end of said ring body by pivotal connection with a lever clevis member that is joined to said first end.

18. The closing ring of claim 17 wherein the connection of said lever and said lever clevis member includes a lever pivot member that is inserted through said lever clevis member and through said lever.

19. The closing ring of claim 18 wherein said link member is connected with the second end of said ring body by pivotal connection with a link clevis member that is joined to said second end.

20. The closing ring of claim 19 wherein the connection of said link member and said link clevis member includes a link pivot member that is inserted through said link clevis member and through said link member.

21. The closing ring of claim 15 wherein said lever is connected with the first end of said ring body by pivotal connection with a lever clevis member that is joined to said first end.

22. The closing ring of claim 21 wherein the connection of said lever and said lever clevis member includes a lever pivot member that is inserted through said lever clevis member and through said lever.

23. The closing ring of claim 15 wherein said link member is connected with the second end of said ring body by pivotal connection with a link clevis member that is joined to said second end.

24. The closing ring of claim 23 wherein the connection of said link member and said link clevis member includes a link pivot member that is inserted through said link clevis member and through said link member.

25. The closing ring of claim 16 wherein said spring-biasing structure includes an elastomeric member assembled to said second closing link.

26. The closing ring of claim 25 which further includes at least one additional link used in combination with the first closing link.

27. The closing ring of claim 26 which further includes at least one additional link used in combination with the second closing link.

* * * * *